US006257742B1

(12) United States Patent
Sjöberg

(10) Patent No.: US 6,257,742 B1
(45) Date of Patent: Jul. 10, 2001

(54) LIGHTING MEANS HAVING LIGHT EMITTING DIODES

(75) Inventor: Jonas Sjöberg, Stockholm (SE)

(73) Assignee: Itab Neon AB, Jonkoping (SE)

( * ) Notice: Subject to any disclaimer, the term of this patent is extended or adjusted under 35 U.S.C. 154(b) by 0 days.

(21) Appl. No.: 09/605,708

(22) Filed: Jun. 27, 2000

Related U.S. Application Data

(63) Continuation of application No. PCT/SE98/02450, filed on Dec. 26, 1998.

(30) Foreign Application Priority Data

Dec. 30, 1997 (SE) ..... 9704927

(51) Int. Cl.[7] ..... F21V 5/00
(52) U.S. Cl. ..... 362/336; 362/309; 362/800
(58) Field of Search ..... 362/800, 336, 362/337, 309

(56) References Cited

U.S. PATENT DOCUMENTS 4,467,193 * 8/1984 Carrell ..... 362/800 X
5,032,963 7/1991 Granström ..... 362/337
5,174,649 * 12/1992 Alston ..... 362/800 X
5,515,253 * 5/1996 Sjobom ..... 362/800 X
5,765,940 * 6/1998 Levy et al. ..... 362/800 X
5,806,969 * 9/1998 Rosengren ..... 362/800 X
5,833,355 * 11/1998 You et al. ..... 362/336 X

FOREIGN PATENT DOCUMENTS

WO 97/26483 7/1997 (WO) .

* cited by examiner

*Primary Examiner*—Laura K. Tso
(74) *Attorney, Agent, or Firm*—Pillsbury Winthrop LLP

(57) ABSTRACT

The present invention is for a lighting means having light emitting diodes. The invention is primarily intended to be used for light signals, e.g. traffic signals. The object of the present invention is a lighting means of the above mentioned kind having light emitting diodes which are arranged in rows and a lens to obtain the desired light pattern. The lighting means comprises a lens (1) and a number of light emitting diodes (3) which are mounted onto the same plate or circuit card (4). The device is enclosed in a common outer enclosure or housing (3). The lens is based upon a cylindrical structure. The inner surface which faces the light emitting diodes is divided into several bands (5) having a linear lens structure where there is one band corresponding to each row of the light emitting diodes. The band (5) is then divided into non-spherical subsurfaces (11, 12, 13, 14).

9 Claims, 4 Drawing Sheets

LIGHTING MEANS HAVING LIGHT EMITTING DIODES

This application is a Con of Pct/SE98/02450 filed Dec. 26, 1998.

The present invention is for a lighting means having light emitting diodes. The means is primarily intended to be used in light signal devices, e.g. traffic light means.

Traffic light means and other signal lamps of similar kinds have hereto had known incandescent filament lamps having a lens positioned in front of the lamp in order to achieve a light pattern according to certain requirements. Incandescent filament lamps have in some lighting means been replaced by light emitting diodes which are mounted in parallel, preferably horizontal, rows. Also this kind of lighting means have a lens to give a light pattern and to equalise the luminance over the surface and reduce the impression of lighting spots or dots. The design of the lens s adapted to the rows of light emitting diodes and the surface of the lens is correspondingly divided into parallel rows or bands. This kind of lenses are known from e.g. U.S. Pat. No. 5,032,963 disclosing a means intended to be used with a single light source which via a reflector emits a parallel beam of rays. The lens is divided into a large number of smaller partial lenses which are arranged in horizontal rows. WO-97/26483 discloses a device for light emitting diodes with a lens where the horizontal bands are divided into several smaller partial bands. At least one of these is in its turn divided into smaller parts which are<arranged at the side of each other having vertical dividing lines or surfaces. These designs are comparatively complicated and bring with them high costs of manufacturing.

One object of the present invention is a lighting means of the above mentioned art having light emitting diodes which are arranged in rows and a lens to give the desired light pattern. Another object of the invention is to eliminate or reduce the impression of separate light spots or dots so that the lighted surface is seen as evened. It is a further object of the invention t achieve the desired light pattern by a simpler lens design without partition of the horizontal bands of the lens in vertically separated parts whereby cost advantages are achieved. It is also an object of the invention to achieve adaptation to light emitting diodes of different luminance.

According to the invention the above mentioned objects are achieved by a linear lens structure comprising a lens which is divided into bands, each band having several curved, nonsphere surfaces. When looked upon each light emitting diodes causes several light spots thereby that each light emitting diode is seen at several positions. If the lighting means is looked at straight or almost straight from the front three or four light spots are seen, from other directions at least two light spots. The impression will be that of a surface which is better enlighted than in the case where one light emitting diode gives only one light spot. The lighting means of the invention has those characteristics which are mentioned in claim 1. Further characteristics of embodiments of the invention are given in the other claims.

The lighting means of the invention will below be described more in detail with reference to the embodiment which is shown in the figures.

Figure 1:
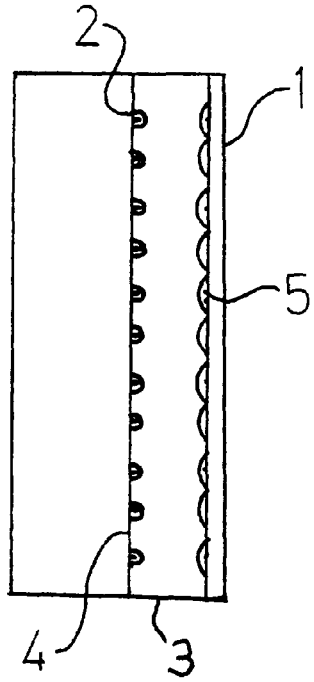
FIG. 1 is a cross-section of a lighting means according to the invention.
Figure 2:
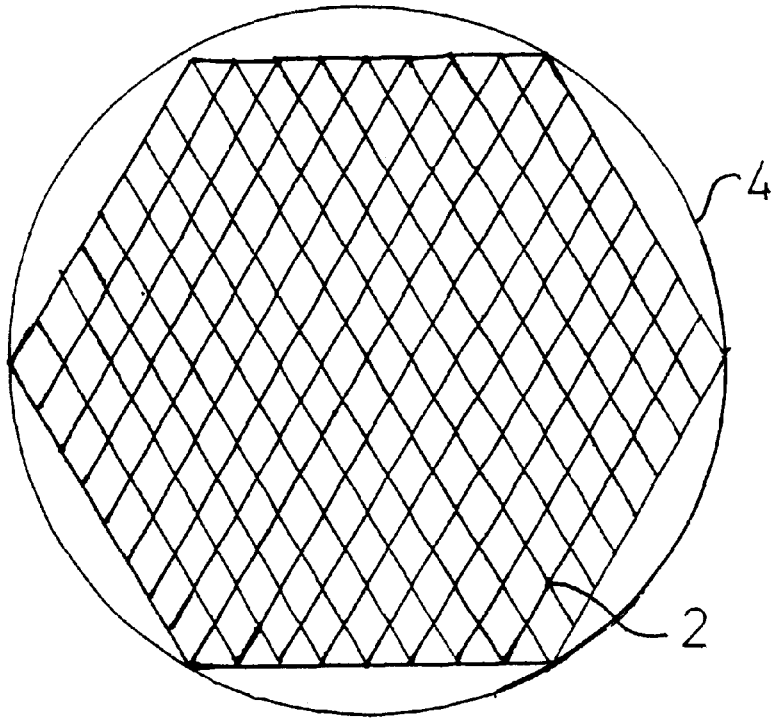
FIG. 2 is a plate for mounting of the light emitting diodes and the positioning of them.
Figure 3:
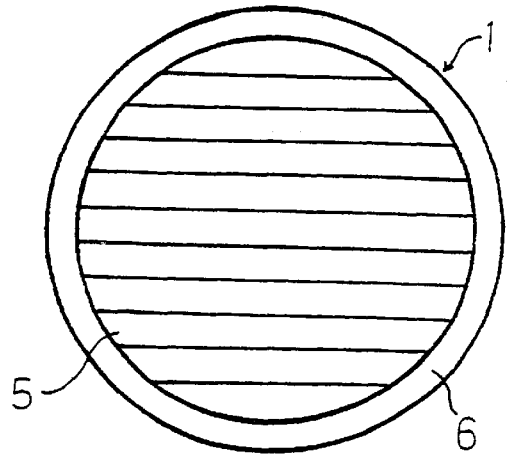
FIG. 3 is a front view of a lens according to the invention.

The light means comprises a lens 1 and a number of light emitting diodes 2 which are mounted on to a common plate or circuit card 4. The device is enclosed in a common outer sheath or housing 3 in which there also are electric and other components as required. The housing is of conventional kind and the means of the invention is intended to allow mounting into existing equipment and then replace previously used light sources and lenses. The outer dimension may be determined based on factors such as dimensions without limiting the invention to the dimensions or embodiments. The number of rows of light emitting diodes may be 7–13, preferably 9–11. It is also suitable to have an odd number of rows so that a symmetrical hexagonal pattern is obtained, in this case preferably 9 or 11 rows. This positioning of the light emitting diodes is shown in principle in FIG. 2 where each point of crossing of the lines represents one light emitting diode.

Figure 4:
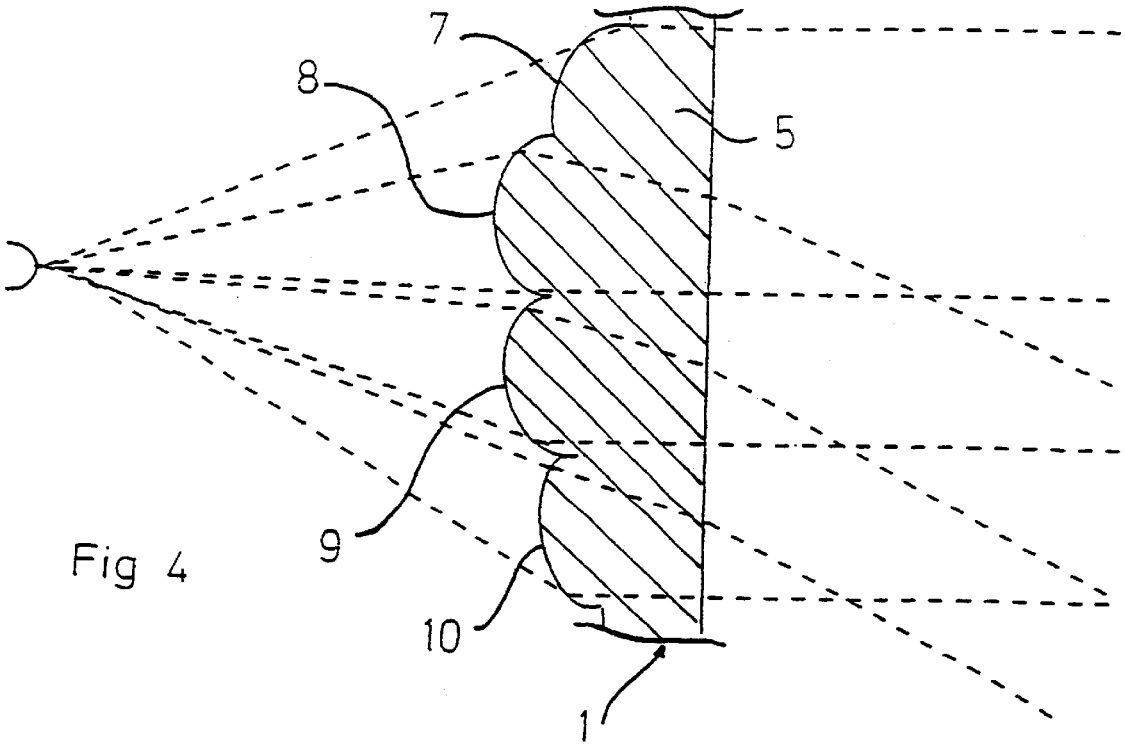
FIG. 4 shows in principle the periodic light directing function of a lens according to the invention.

The lens 1 is based upon a cylindrical structure so that the desired flexibility and adaptation to light emitting diodes of different luminance shall be obtained. The lens has one surface which is turned away out from the light emitting diodes and which preferably is flat although it may also be somewhat convex. The inner surface which faces the light emitting diodes is divided into several bands 5 having a linear lens structure where one band corresponds to each row of light emitting diodes. The lens also has an outer brim 6 for mounting into the housing 3 in known way The periodical light directing function which is obtained by a lens having non-spherical surfaces is shown in principle in FIG. 4. One band 5 of the lens 1 has four subbands 7, 8, 9, 10 each of which has a non-spherical surface facing the light emitting diodes. Some light beams have been indicated by broken lines and show how the light is refracted both to a direction straight forwards, i.e. a right angle to the flat surface of the lens and a direction angled downwards so that the incandescent surface will be more even than if a simple cylindrical lens is employed.

The light emitting diodes have a capsule 15 which encloses the light source which is situated 6–7 mm behind the top of the capsule. he distance between the top of the capsule and the nearest surface of the lens is in the interval of 20–35 mm, preferably 25–30 mm. A shorter distance brings with it a too great sensitivity for incorrect position of individual light emitting diodes and reduces the possibility to optically focus and concentrate the light in the desired direction while a longer distance requires that the lens is too large for efficient light collection. The light emitting diodes are directed with their centre axis at right angle to the plate 4 and the flat, outer surface of the lens 1. The light emitting diodes of the outer rows, i.e. the top and the bottom rows, are directed downwards and upwards respectively by 1–2° deviating from this direction in order to achieve the best light efficiency.

Figure 5:
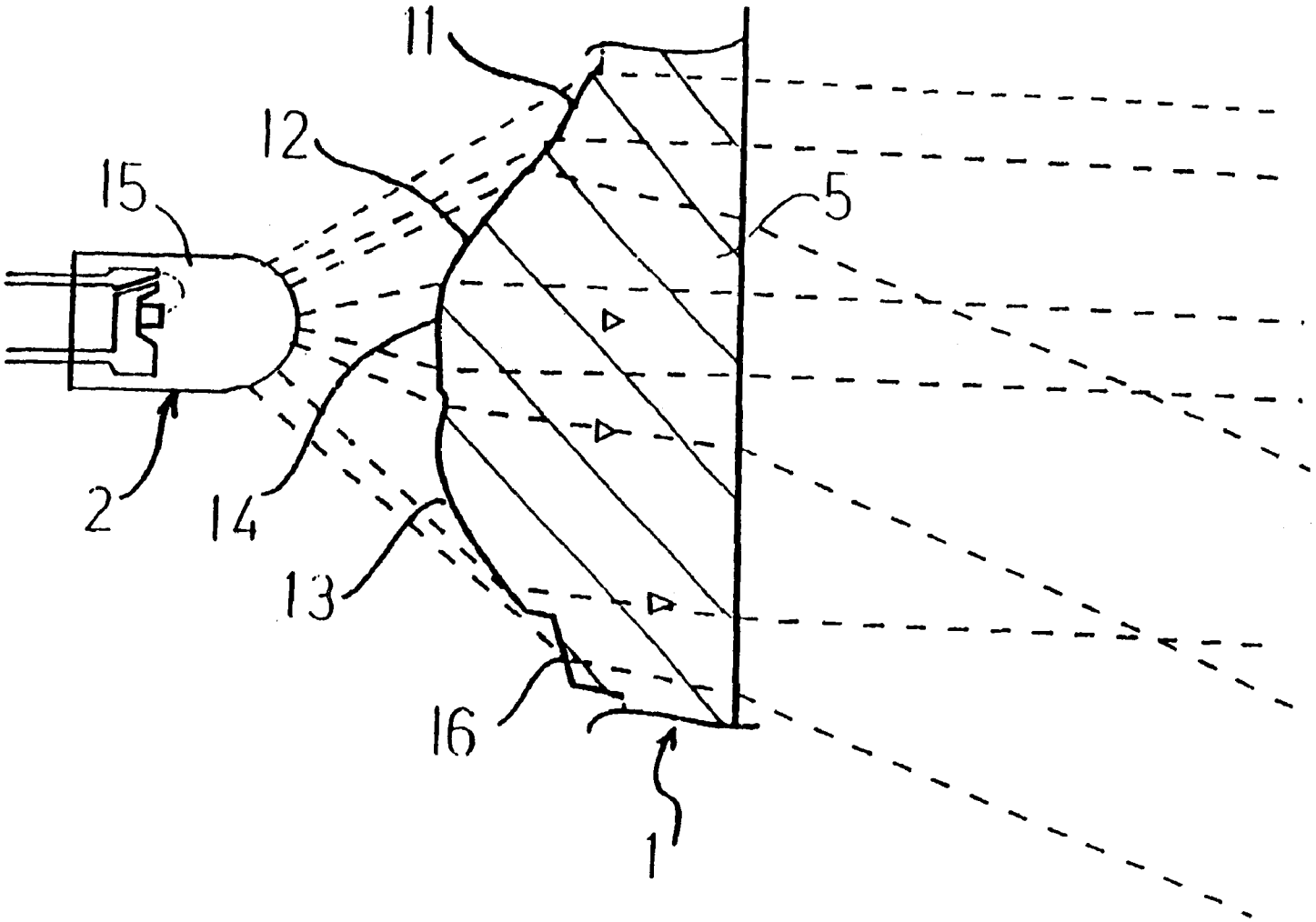
FIG. 5 is a cross-section of a horizontal band and a light emitting diode of a lighting means according to the invention.

A preferred embodiment of the invention is shown in FIG. 5. The band 5 is then divided into four non-spherical subsurfaces 11, 12, 13, 14. In order to make the thickness of the lens more even and thereby obtain both optical and manufacturing advantages there is a filler being a flat surface 16 at the bottom of the band. The light deflection for the outer beams is minimised by that the light is directed horizontally forwards by the uppermost lens surface 11 while the lowermost, flat surface 16 directs the light downwards. Generally the light which is emitted by the diodes is utilised within a vertical angle of 40–50°. The passages between the non-spherical surfaces are made as smooth as possible so that the loss of light shall be as small as possible. In this case there is a discontinuity between the subsurfaces 13 and 14 while the other passages are rounded surfaces.

Figure 6:
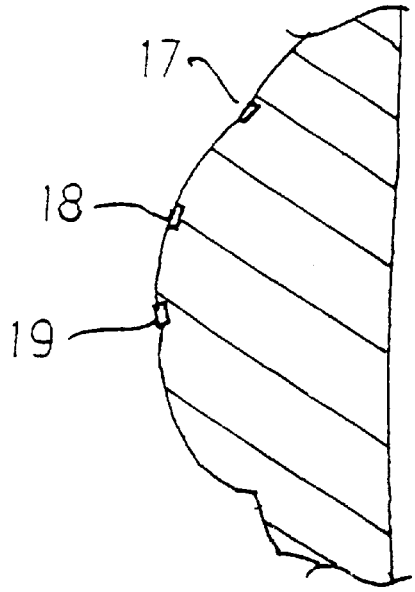
FIG. 6 is an alternative embodiment of a horizontal band.
Figure 7:
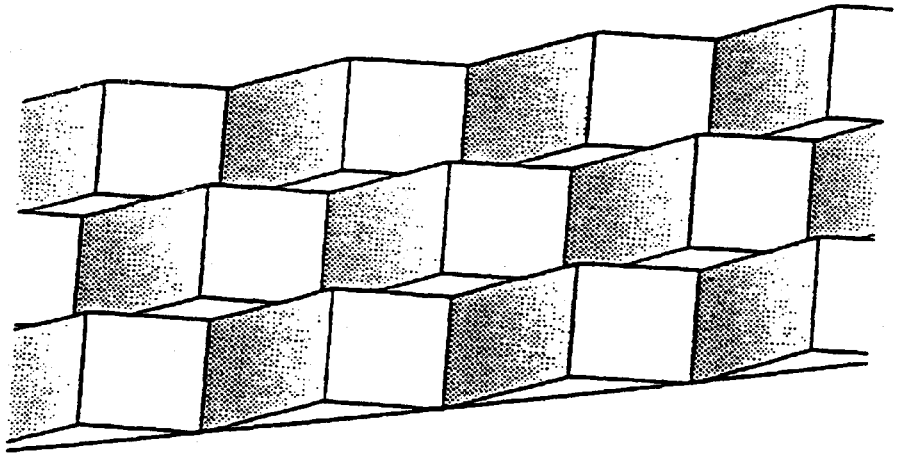
FIG. 7 shows a surface with facets.
Figure 8:
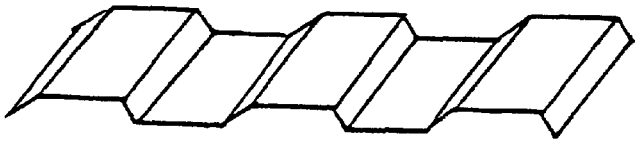
FIG. 8 shows a surface with prisms.

The width of the light pattern may be further widened by that one or more rows of facets, prisms or the like are positioned between adjacent non-spherical surfaces or adjacent to an outer non-spherical surface. An example of an embodiment of this kind is shown in FIG. 6 where the lens has three such horizontal rows 17, 18, 19. These rows or strips are narrows compared to the individual non-spherical surfaces and they are designed having a great number of facet surfaces or prism surfaces. A part of such a row is shown in FIG. 7 from which it appears that the facet surfaces are arranged in three lines. In the embodiment which is shown all of the facet surfaces are of the same size and are at the same angle at a plane parallel to the outside of the lens. In other embodiments both the size of the surfaces and their angles to each other may be irregular. Another embodiment with irregular prisms is shown in FIG. 8. The design of the individual prisms may then be varied in various ways in order o obtain the desired results. In the embodiments where light spreading strips of this kind are used the number of rows is adapted to the application and usually varies between 1 and 3 rows.

Various other embodiments besides those described above are possible within the frame of the inventive idea. These may mean adaptation to specific requirements or further developed component parts, primarily light emitting diodes or other corresponding light sources.

What is claimed is:

1. An apparatus comprising:

light emitting diodes, the light emitting diodes being arranged in rows;

a lens having a surface divided into bands, each of the bands corresponding to one of the rows of light emitting diodes and having at least three subbands, each of the subbands including a cylindrical lens having a convex, non-spherical surface.

2. The apparatus according to claim 1, wherein each of the bands includes four subbands.

3. The apparatus according to claim 1, further comprising a flat surface positioned adjacent to one of the non-spherical surfaces.

4. The apparatus according to claim 1, wherein the number of rows of light emitting diodes includes an odd number of rows of light emitting diodes.

5. The apparatus according to claim 4, wherein the number of rows of light emitting diodes includes one of 9 and 11 rows of light emitting diodes.

6. The apparatus according to claim 1, wherein one of the light emitting diodes in one of the rows is sloped towards another of the rows of light emitting diodes.

7. The apparatus according to claim 1, further comprising at least one of a facet surface and a prism surface arranged adjacent to at least one of the non-spherical surfaces.

8. The apparatus according to claim 1, wherein the light emitting diodes are arranged in horizontal rows.

9. The apparatus according to claim 1, wherein the subbands are arranged along the entire length of the band.

* * * * *